US009409221B2

(12) United States Patent
Kobayashi

(10) Patent No.: US 9,409,221 B2
(45) Date of Patent: Aug. 9, 2016

(54) METHOD OF HOT-PRESS FORMING ENABLING HARDNESS CONTROL

(75) Inventor: Masanori Kobayashi, Kanagawa (JP)

(73) Assignee: TOPRE CORPORATION, Tokyo (JP)

( * ) Notice: Subject to any disclaimer, the term of this patent is extended or adjusted under 35 U.S.C. 154(b) by 400 days.

(21) Appl. No.: 13/638,952

(22) PCT Filed: Mar. 28, 2011

(86) PCT No.: PCT/JP2011/057591

§ 371 (c)(1),
(2), (4) Date: Oct. 2, 2012

(87) PCT Pub. No.: WO2011/132501

PCT Pub. Date: Oct. 27, 2011

(65) Prior Publication Data

US 2013/0025340 A1 Jan. 31, 2013

(30) Foreign Application Priority Data

Apr. 23, 2010 (JP) ..... 2010-099346

(51) Int. Cl.
*B21D 22/02* (2006.01)
*B21D 22/20* (2006.01)
(Continued)

(52) U.S. Cl.
CPC ..... *B21D 22/02* (2013.01); *B21D 22/208* (2013.01); *B21D 37/16* (2013.01); *C21D 1/18* (2013.01);
(Continued)

(58) Field of Classification Search
CPC ..... B21D 24/00; B21D 24/04; B21D 22/20; C21D 1/673; B23K 2201/18; B23D 15/00–36/00
USPC ..... 72/38, 342.1, 345.2, 342.5, 342.6, 72/342.94, 362, 364, 700, 332, 60, 348, 72/351, 465.1, 466.9, 350; 148/654, 649
See application file for complete search history.

(56) References Cited

U.S. PATENT DOCUMENTS 4,698,103 A * 10/1987 Hoogendoorn et al. ..... 148/504
6,027,587 A * 2/2000 Hodgson ..... C21D 7/13 D7/13

(Continued)

FOREIGN PATENT DOCUMENTS

CN 1753740 3/2006
JP 2003-328031 11/2003

(Continued)

OTHER PUBLICATIONS

Davenport, S.B., On the effect of fully reversed deformation on the austenite to ferrite phase transformation in C-Mn steel, Nov. 21, 2001, Elsevier Science Ltd., Scripta Materials 46 (2002) p413-417.*

(Continued)

*Primary Examiner* — Shelley Self
*Assistant Examiner* — Gregory Swiatocha
(74) *Attorney, Agent, or Firm* — Greenblum & Bernstein, P.L.C.

(57) ABSTRACT

A hardenable steel sheet is treated with press-forming by means of a die. The method is comprised of: heating the steel sheet to a temperature of an $Ac_3$ point or higher; carrying out a primary press on the heated steel sheet so as to give a local strain to a limited part of the steel sheet; keeping the steel sheet in a state apart from the die shortly after the primary press; and carrying out a press on the steel sheet kept in the state and retain the steel sheet in close contact with the die.

17 Claims, 21 Drawing Sheets

(51) Int. Cl.

| | |
|---|---|
| ***B21D 37/16*** | (2006.01) |
| ***C21D 1/18*** | (2006.01) |
| ***C21D 1/673*** | (2006.01) |
| ***C21D 7/13*** | (2006.01) |
| ***C21D 8/04*** | (2006.01) |
| ***C21D 9/46*** | (2006.01) |
| ***C22C 38/02*** | (2006.01) |
| ***C22C 38/04*** | (2006.01) |
| ***C22C 38/18*** | (2006.01) |

(52) U.S. Cl.

CPC ..... *C21D 1/673* (2013.01); *C21D 8/0447* (2013.01); *C21D 9/46* (2013.01); *C22C 38/02* (2013.01); *C22C 38/04* (2013.01); *C22C 38/18* (2013.01)

(56) References Cited

U.S. PATENT DOCUMENTS

| | | | | |
|---|---|---|---|---|
| 7,004,004 | B2 * | 2/2006 | Arns et al. | 72/342.1 |
| 8,486,206 | B2 | 7/2013 | Litalien et al. | |
| 2003/0066581 | A1 * | 4/2003 | Gehringhoff et al. | 148/624 |
| 2005/0257862 | A1 * | 11/2005 | Asai et al. | 148/654 |
| 2006/0219334 | A1 * | 10/2006 | Brodt et al. | 148/647 |
| 2009/0007999 | A1 * | 1/2009 | Asai | 148/654 |
| 2011/0016944 | A1 * | 1/2011 | Tamai | 72/358 |
| 2011/0283851 | A1 * | 11/2011 | Overrath et al. | 83/15 |
| 2011/0315281 | A1 * | 12/2011 | Charest et al. | 148/567 |

FOREIGN PATENT DOCUMENTS

| | | | |
|---|---|---|---|
| JP | 2005-138111 | | 6/2005 |
| JP | 2005-145168 | | 6/2005 |
| JP | 2006-212690 | | 8/2006 |
| JP | 2006-283064 | | 10/2006 |
| JP | 2007-136534 | | 6/2007 |
| JP | 2007136534 | A * | 6/2007 |
| JP | 2009-101378 | | 5/2009 |
| JP | 2009101378 | A * | 5/2009 |

OTHER PUBLICATIONS

Chinese Office Action, dated Apr. 30, 2014, in counterpart Chinese Application No. 201180020492.5.

International Search Report, mail date is Jun. 7, 2011.

Japan Office action, dated Sep. 24, 2014, along with an English translation thereof.

* cited by examiner

METHOD OF HOT-PRESS FORMING ENABLING HARDNESS CONTROL

TECHNICAL FIELD

The present invention relates to a method of hot-press forming that employs quenching to increase hardness of a press-formed product and further enables regulation of hardness of limited part thereof.

BACKGROUND ART

For the purpose of strength improvement and weight reduction, high-strength steel sheets are not infrequently used. When carrying out cold-press, a high-strength steel sheet may considerably spring back as a natural result of its high strength, thereby often causing an issue in shape-fixability. To solve this issue, one may select hot-press instead of cold-press and exploit close contact with dies to carry out quenching and hardening of the sheet so as to increase hardness of the press-formed product. This is referred to as die-quenching, alternatively, press-hardening or hot stamping.

In die-quenching, a steel sheet is heated up to a proper temperature beyond the $Ac_3$ point, 1000 degrees C. for example, so that its structure turns into austenite. Next the steel sheet is taken out of the furnace and, while being air-cooled, is treated with pressing at a proper temperature where the austenite phase is still stable, 800 degrees C. for example. Then quenching resulting from close contact with dies causes the martensite transformation, thereby hardening and strengthening the press-formed product. Its tensile strength is, for example, about 1470 MPa and its Vickers hardness HV is about 440. More specifically, a steel sheet formed by this method has a sufficient strength. The steel sheet under forming is sufficiently soft because the pressing is carried out in a hot process, thereby alleviating the issue of spring-back and producing a precise shape.

When a product formed by die-quenching is to be further machined, or processed in any way, another issue will arise. Japanese Patent Application Laid-open No. 2003-328031 reports that increase of hardness at surfaces of the formed product increases shearing resistance and therefore makes it difficult to carry out piercing or trimming.

DISCLOSURE OF INVENTION

In a case where a hot-pressed product hardened by quenching is to be further machined, or processed in any way, or in a case where any special need arises, it is desirable that hardness at limited part of a quenched and formed product is locally regulated. The present invention has been achieved in view of such a standpoint and is intended to provide a method of hot-press forming that enables regulation of hardness of limited part.

In a method according to an aspect of the present invention, a hardenable steel sheet is treated with press-forming by means of a die. The method is comprised of: heating the steel sheet to a temperature of an $Ac_3$ point or higher; carrying out a primary press on the heated steel sheet so as to give a local strain to a limited part of the steel sheet; keeping the steel sheet in a state apart from the die shortly after the primary press; and carrying out a press on the steel sheet kept in the state and retain the steel sheet in close contact with the die.

BEST MODE FOR CARRYING OUT THE INVENTION

Certain embodiments will be described hereinafter with reference to the appended drawings.

In the present embodiment, a hardenable steel sheet is treated with hot-press forming. A method of hot-press forming is, in general, comprised of heating the steel sheet to a temperature of an $Ac_3$ point or higher, carrying out a primary press on the heated steel sheet so as to give a local strain to a limited part of the steel sheet, keeping the steel sheet in a state apart from the dies shortly after the primary press, and again carrying out a press on the steel sheet kept in the state and retain close contact with the dies for a fixed period of time. Because part given a local strain is limited and becomes less in hardness than the other parts (more specifically, the hardness is locally regulated), the part at issue is preferable for a shearing process such as piercing or trimming. Further detailed descriptions about the respective steps will be given hereinafter.

Referring to FIGS. 1 through 4, to limited part of a steel sheet W, preferably a preliminary deformation is given. While more detailed descriptions will be given later, the part given the preliminary deformation will be squashed at a step of a primary press described later, thereby a local strain is given to the steel sheet W. It is advantageous in that a flat surface will be at last obtained whereas the method includes the step of giving the local strain to the steel sheet W in accordance with this method.

Figure 1:
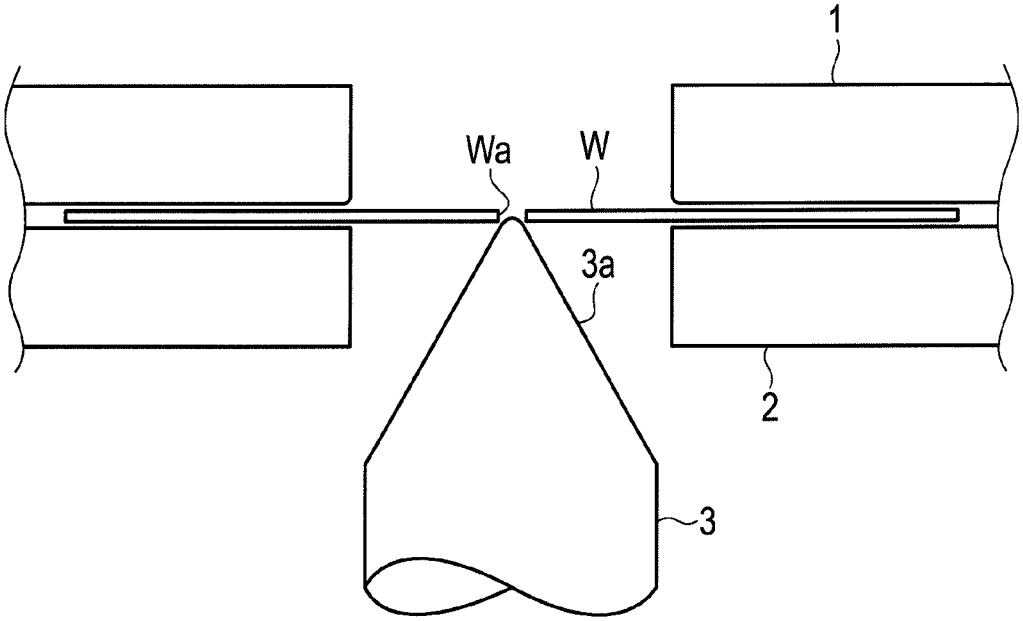
FIG. 1 is an elevational view depicting an example of a step of giving a preliminary deformation to a steel sheet before a primary press in a method of hot-press forming according to an embodiment of the present invention.
Figure 2A:
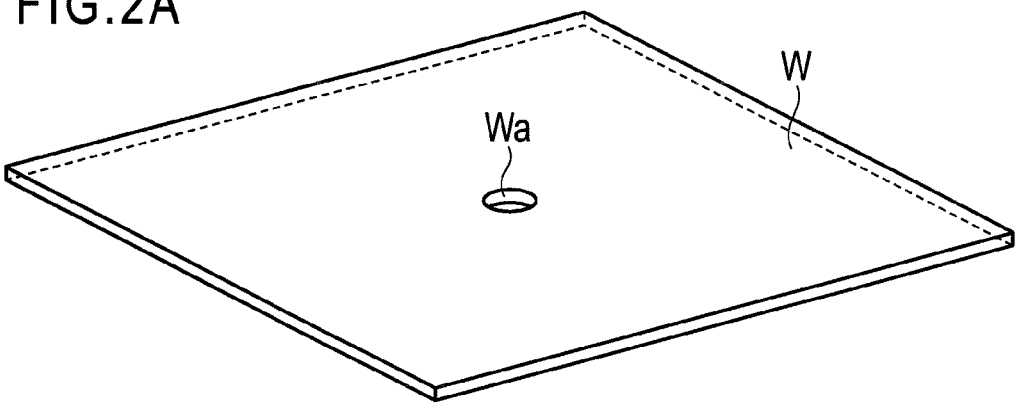
FIG. 2A is a perspective view of the steel sheet before being given the preliminary deformation.
Figure 2B:
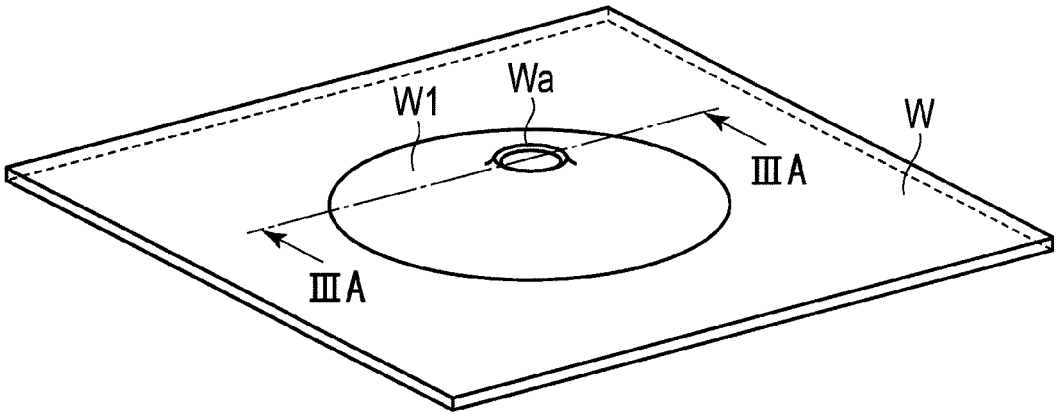
FIG. 2B is a perspective view of the steel sheet after being given the preliminary deformation.

Preferably to the part at issue, a hole Wa is in advance opened as shown in FIG. 2A. The steel sheet W is grasped between a die 1 and a blank holder 2 as shown in FIG. 1. A punch 3 of a round bar and having a pointed tip 3*a* is pressed onto the hole Wa to deform it, thereby giving a preliminary deformation to the steel sheet W around the hole Wa. FIG. 2B shows a mode in that the steel sheet W comes to have a convex W1 by means of the preliminary deformation.

As the preliminary deformation is greater, it is enabled to give a greater local strain by a primary press described later, which results in greater effects. The aforementioned process in that the hole Wa is provided and then its periphery is deformed is advantageous in a point that a greater preliminary deformation is produced.

Alternatively, the hole Wa may be omitted as long as a preliminary deformation to a required degree is given. Instead of pressing the punch 3 onto the steel sheet, any proper method such as bending, indenting, burring, or embossing is applicable. Some of these methods will be described later in more detail.

The step of giving a preliminary deformation may be carried out before or after the heating step. Alternatively, a local strain may be given without giving a preliminary deformation as described later.

Figure 4:
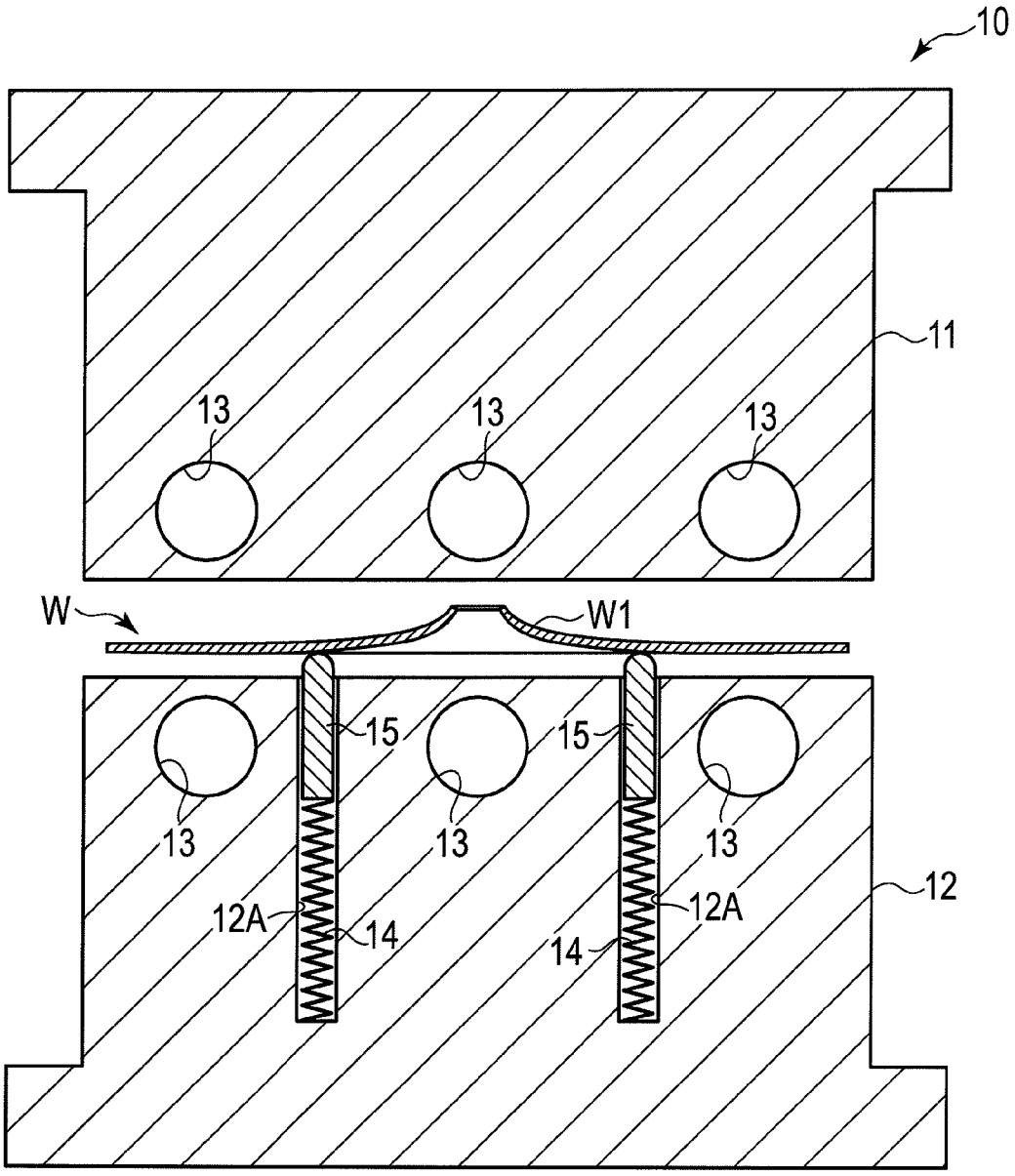
FIG. 4 is a schematic elevational sectional view of the dies and the steel sheet applied to the method of hot-press forming.
Figure 19:
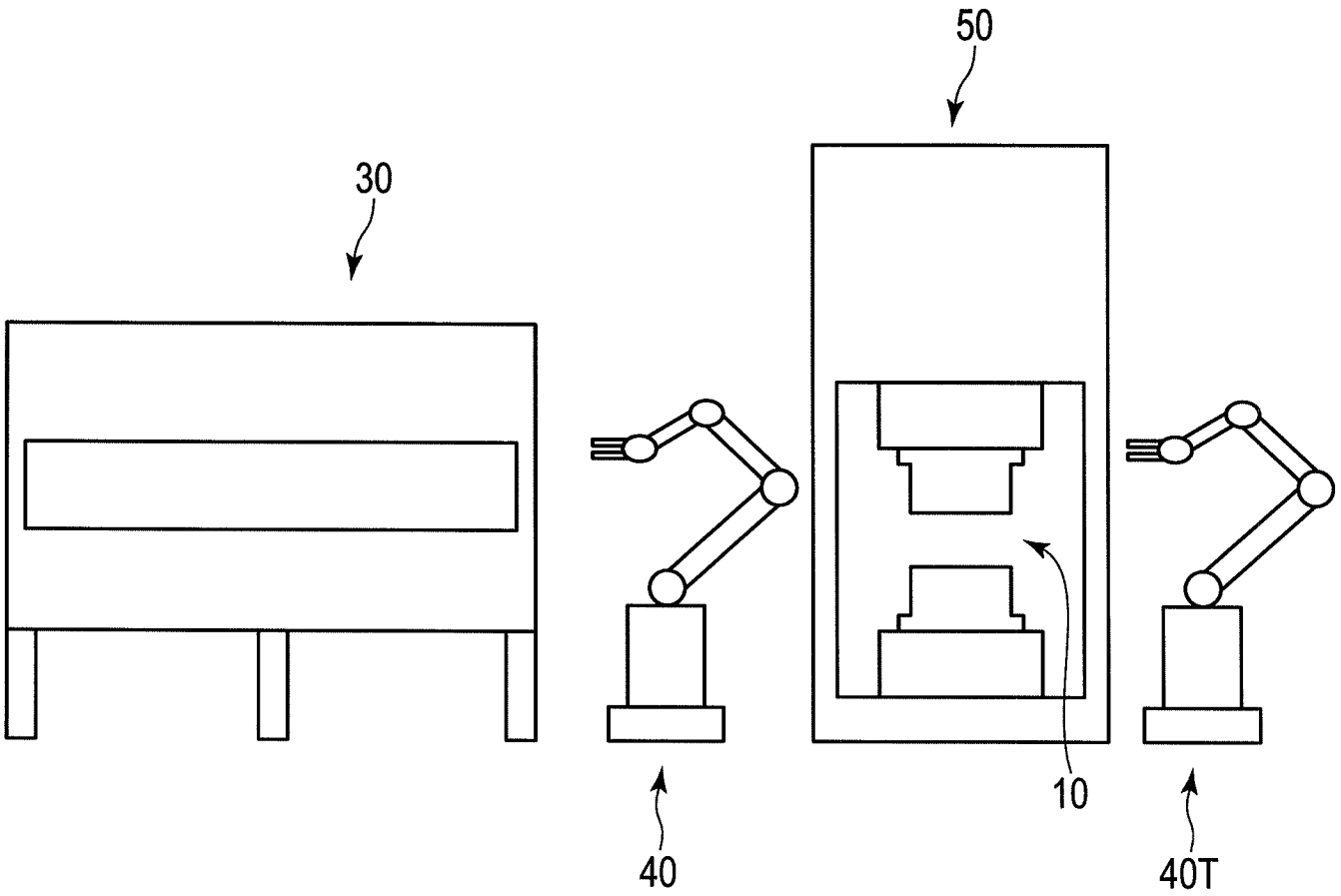
FIG. 19 is a schematic drawing showing an overview of a facility for hot-press forming.

The hot-press forming is carried out by means of a device schematically shown in FIG. 4 and FIG. 19. This device is comprised of a proper heating furnace 30 and a press machine 50, and preferably further comprised of a transporting device 40 for transporting a steel sheet from the furnace 30 to the press machine 50 and a conveyance machine 40T for taking out products after press-forming. To the transporting device 40 and the conveyance machine 40T applicable are, not limited to, robot arms.

The press machine 50 is comprised of dies 10, which are normally comprised of an upper die 11 and a lower die 12. The lower die 12 is normally immovable relative to a floor, and the upper die 11 is capable of ascending and descending by means of hydraulic means or any other means. The upper die 11 and the lower die 12 are respectively comprised of a plurality of conduits 13 through which a medium for cooling passes. The medium is normally water. The lower die 12 is comprised of a plurality of vertical holes 12A. Each hole 12A liftably houses a lift pin 15 supported by a spring 14. Each lift pin 15, when bearing no load, has its top end projected upward from the lower die 12, and in turn, when bearing a load, sinks into the vertical hole 12A. Preferably the top end of each lift pin has a spherical shape or a rounded conical shape.

The steel sheet W is heated to any temperature of the $Ac_3$ point or higher in the heating furnace 30 so that its structure turns into austenite. The $Ac_3$ point is a temperature at which transformation from ferrite into austenite completes, which almost exclusively depends on alloy composition of the steel sheet W. As the $Ac_3$ point is well-known, the heating temperature can be determined on the basis of the well-known value but any definite expedient temperature may be selected. More specifically, the heating temperature may be determined to be any in a range of 900 through 950 degrees C.

Figure 18:
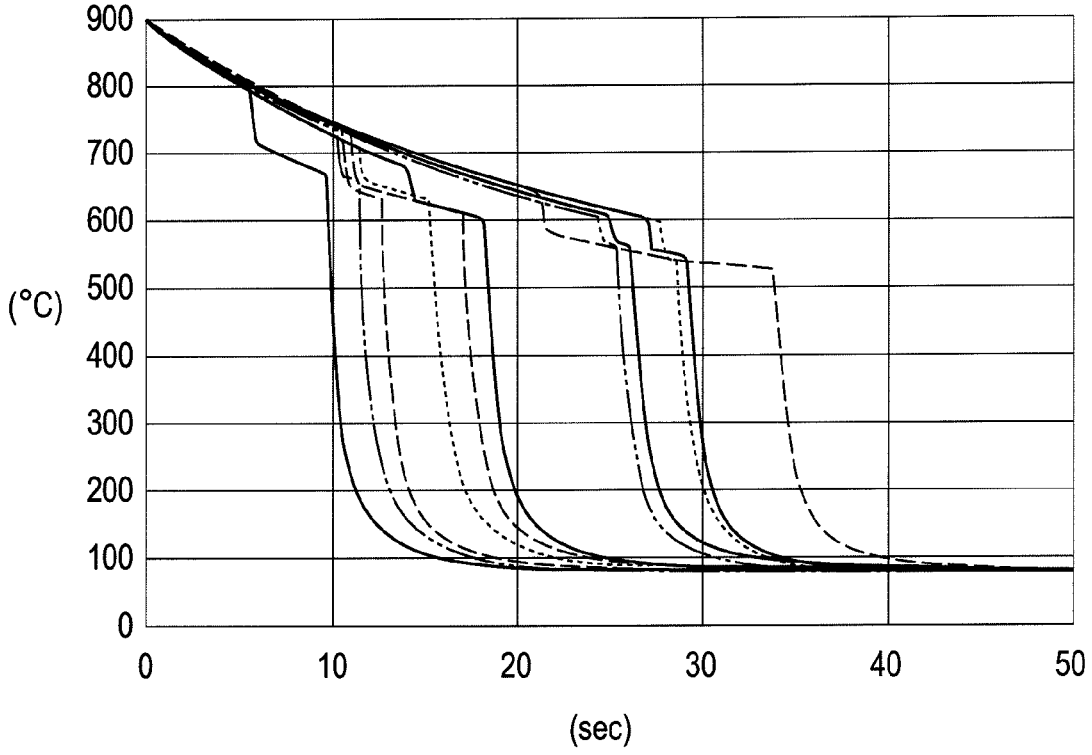
FIG. 18 shows examples of temperature profiles of steel sheets.

The steel sheet W as heated in a way described above is introduced into the press machine 50 and then placed on the lower die 12. The steel sheet W is supported by point contact with the lift pins 15 and is therefore not quenched by close contact with dies. The steel sheet W is subject to natural air cooling and therefore experiences a gradual drop in temperature. While it is required to grasp temperature change of the steel sheet W, its temperature can be measured by means of any known measurement means such as a radiation pyrometer or a thermocouple. FIG. 18 shows examples of results of measurement. One may carry out measurement of temperature changes about a considerable number of combinations of various dimensions of steel sheets and then establish a database of temperature profiles. Instead of measuring temperature change on each occasion of hot-press forming, one may estimate temperature change on the basis of such a database.

The steel sheet W is treated with the primary press at a proper temperature at which the austenite phase is still stable, or any temperature from 600 to 800 degrees C. for example, to produce a local strain therein.

Figure 2C:
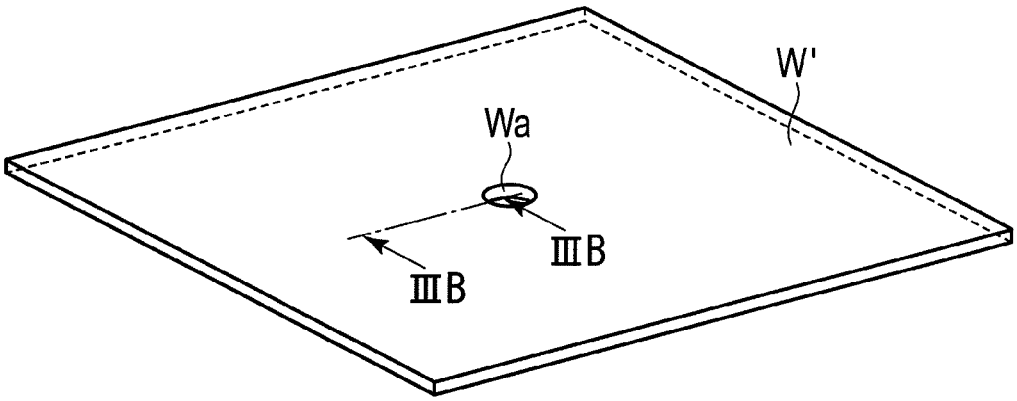
FIG. 2C is a perspective view of the steel sheet after being treated with the primary press in the method of hot-press forming.
Figure 5:
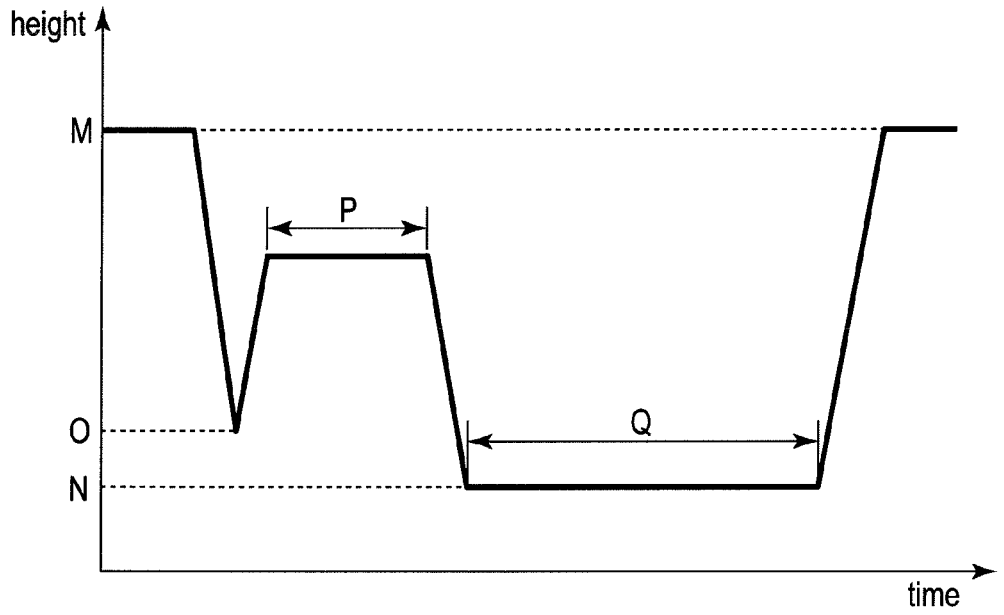
FIG. 5 is a drawing schematically depicting action of the upper die in the hot-press forming.

Referring to FIG. 5, the upper die 11 is at a height M where the steel sheet W is not in contact therewith. When the upper die 11 is pressed down (to a height O) and shortly thereafter made to ascend, the convex W1 is squashed as shown in FIG. 2C to produce a flat steel sheet W'. The press-down force is for example 2.5 MPa in surface pressure. Then, as being in close contact with cold dies, relatively rapid cooling may occur for a very short period of time but it does not cause martensite transformation. The upper die 11 ascends just after that and then the repulsive force of the springs 14 makes the steel sheet W' apart from the lower die 12. Thus it turns back to a state of gradual temperature drop. For a proper period of time P, the steel sheet W' is kept in this state.

The part given the preliminary deformation is squashed in the primary press step and is thus given a local strain. As the steel sheet W' is subsequently kept in a state where it is apart from the dies, ferrite transformation occurs as being induced by the strain although the high temperature where the austenite phase is still stable is retained. Time required for this ferrite transformation is generally about several seconds although it may depend on the alloy composition of the steel sheet W and the degree of the induced strain. Therefore, in view of causing sufficient ferrite transformation induced by the strain, the keeping time P is beyond 0 seconds and preferably a properly long time as long as the austenite phase at the other parts is maintained. The keeping time P is more preferably from 1 second through 5 seconds, or further preferably from 1 second through 3 seconds.

Figure 3A:
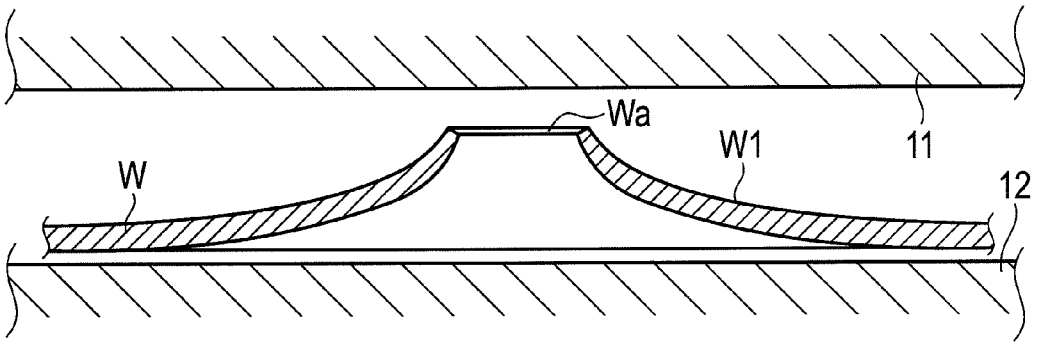
FIG. 3A is an elevational sectional view of a steel sheet and dies for pressing according to an example in that use of a punch gives a preliminary deformation to the steel sheet.
Figure 3B:
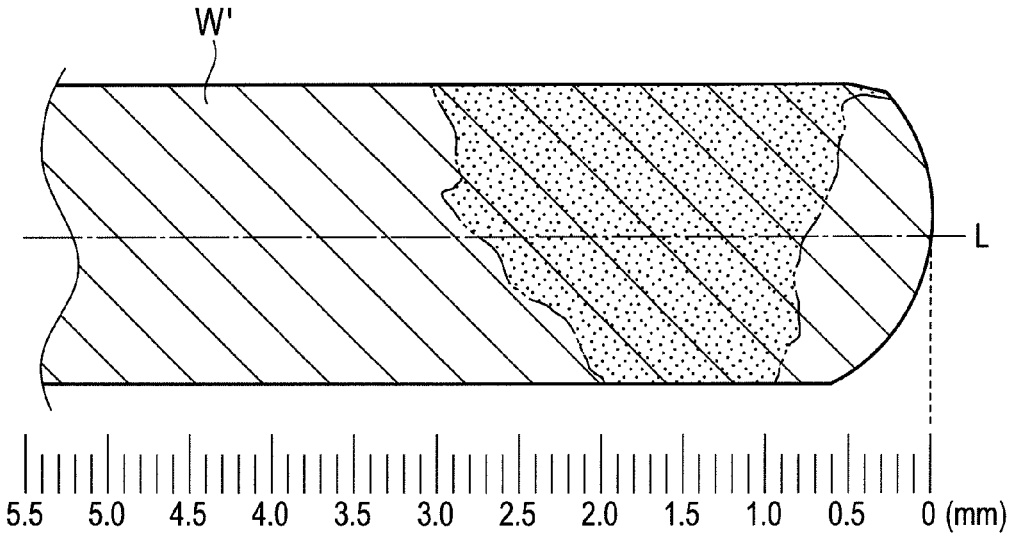
FIG. 3B is an enlarged sectional view around part given a local deformation of the steel sheet after being treated with the primary press.

At any parts not given a local strain, any particular transformation does not occur even though the primary press is done. The ferrite transformation is limited at the part given the local strain. More specifically, this step locally generates the ferrite phase in the steel sheet W'. In FIG. 3B, halftone dots are given to areas where the ferrite phase induced by the strain is generated and thereby hardness after hardening is lower than HV370.

The steel sheet is treated with the final press at a proper temperature at which the austenite phase is still stable, or any temperature from 600 to 800 degrees C. for example, by again pressing the upper die 11 down to a bottom dead point N. The press-down force is for example 15 MPa in surface pressure. In this press step, the upper die 11 is kept pressed down for a considerable period of time Q. During this time, close contact with the cold dies makes the process of hardening of the steel sheet W' progress.

Then, at parts not given the local strain, as the austenite phase transforms into the martensite phase, increase in hardness and strength occurs. At the part given the local strain, as the ferrite transformation occurs in advance, a ratio of the austenite phase is small. Therefore as a room for producing the martensite transformation is short, increase in hardness and strength is limited. More specifically, hardness at a limited part is locally regulated.

Figure 9:
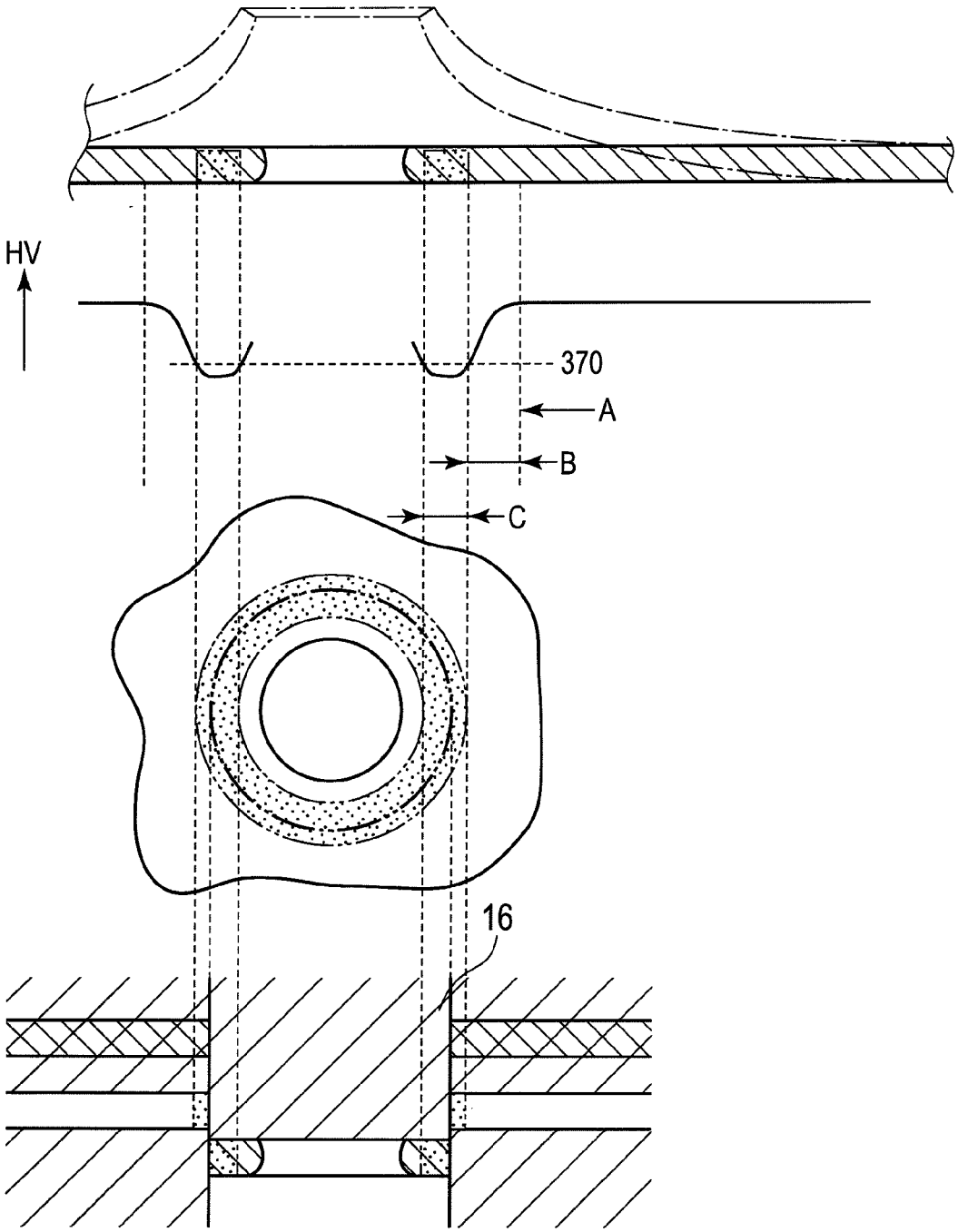
FIG. 9 is a schematic drawing depicting a way of shearing a steel sheet having a limited part of locally regulated hardness.

FIG. 9 schematically shows a way of local regulation of hardness. Locally around the hole Wa, like as a concentric circle thereof, a part C where the ratio of the martensite phase is low is generated. At this part, the Vickers hardness HV is 370 or less for example, which is adapted for carrying out shearing such as piercing or trimming. At a part A apart from the part C, hardness and strength are sufficiently high and a boundary part B therebetween is sufficiently narrow.

As a post-process, shearing such as piercing or trimming may be carried out. FIG. 9 shows an example in which piercing is carried out with using a tool 16. Alternatively, any proper process such as bending, indenting or embossing may be carried out. As hardness at the part subject to these processes is regulated to be sufficiently soft, these processes are readily carried out and further exhaustion of applied tools is prominently reduced. While residual stress after machining, or processed in any way, may often cause delayed fracture, as the subject part is sufficiently low in hardness, delayed fracture is unlikely to occur at the part. As the part where hardness is locally regulated is limited to a sufficiently narrow area, the product as a whole has sufficient hardness and strength.

To demonstrate the effects, the following experiments were executed.

Steel sheets of 1.8 mm in thickness and each having a composition of C: 0.22 mass %, Si: 0.26 mass %, Mn: 1.22 mass %, P: 0.021 mass %, S: 0.02 mass %, Cr: 0.20 mass %, and iron substantially as the remaining part thereof are served for test pieces. A hole of 5 mmΦ was opened on each test piece and a preliminary deformation was given thereto with having the hole to be its center by means of a punch. Each test piece was heated up to 900 degrees C. and introduced into a press machine, and then the primary press was carried out to give thereto a local strain. The press-down force was 5 tons (2.5 MPa in surface pressure). There were tested five levels of the starting temperatures of the primary presses, namely 600 degrees C., 650 degrees C., 700 degrees C., 750 degrees C. and 800 degrees C., and four levels of the keeping times, namely 0 seconds (immediately carrying out the final press), 1 second, 3 seconds and 5 seconds. Next the final press was carried out with press-down force of 30 tons (15 MPa in surface pressure) to execute forming and hardening. Thereafter the vicinity of each hole was cut and, on its section, Vickers hardness measurement was carried out at every 0.25 mm from the edge of the hole along a line L in FIG. 3B. Results are shown in FIGS. 6-8.

Figure 6:
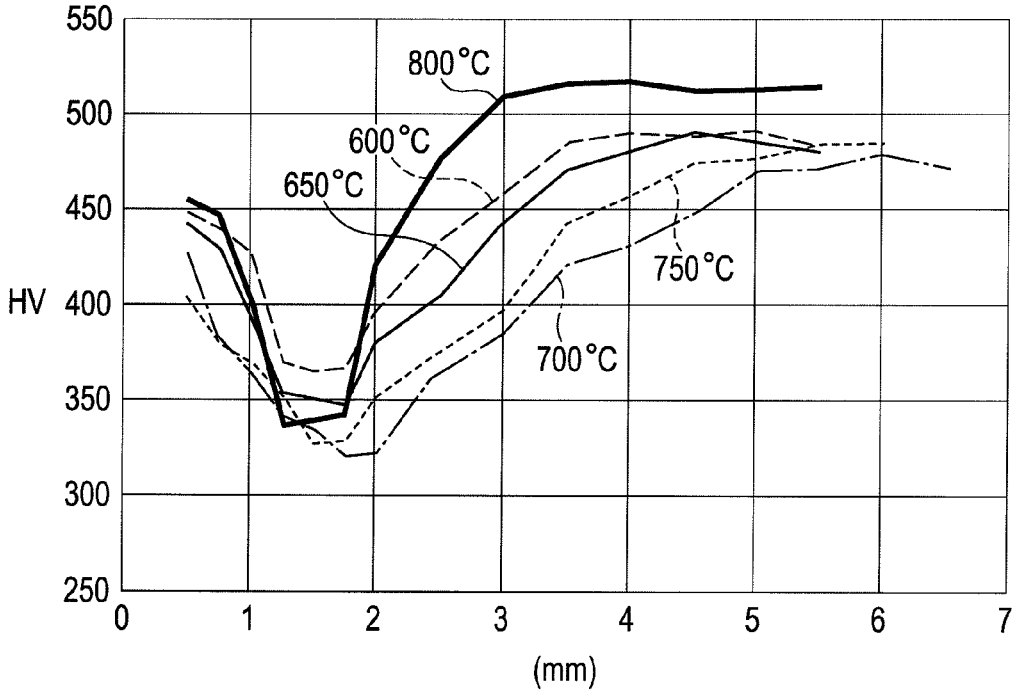
FIG. 6 is a graph depicting distributions of hardness after hardening, which explains a relation between temperatures for the primary press and the hardness distributions.

FIG. 6 shows a relation between starting temperatures of the primary press and Vickers hardness HV after hardening in a case where the keeping time was 3 seconds. The axis of abscissas means distances from the edge of the hole. In any examples, any points sufficiently apart from the edge of the hole presented HV of 470 or more and are thus acknowledged to be sufficiently hardened. On the other hand, the region of from 1 mm through 3 mm apart from the edge of the hole presented lower HV, and in particular the region of from 1.25 mm through 1.75 mm presented HV of 370 or less. More specifically, this region is locally regulated in regard to its hardness, and is adapted for being treated with shearing such as piercing or trimming. On the basis of these results, the starting temperature of the primary press is preferably from 600 to 800 degrees C.

Figure 7:
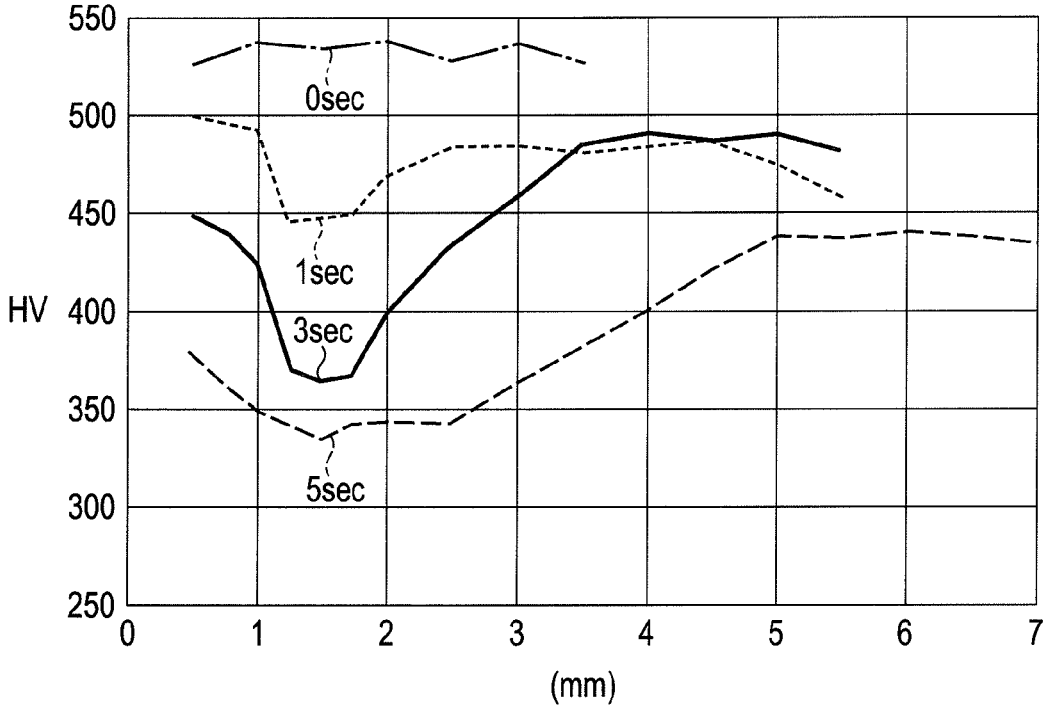
FIG. 7 is a graph depicting distributions of hardness after hardening, which explains a relation between keeping times after the primary press at 600 degrees C. and the hardness distributions.
Figure 8:
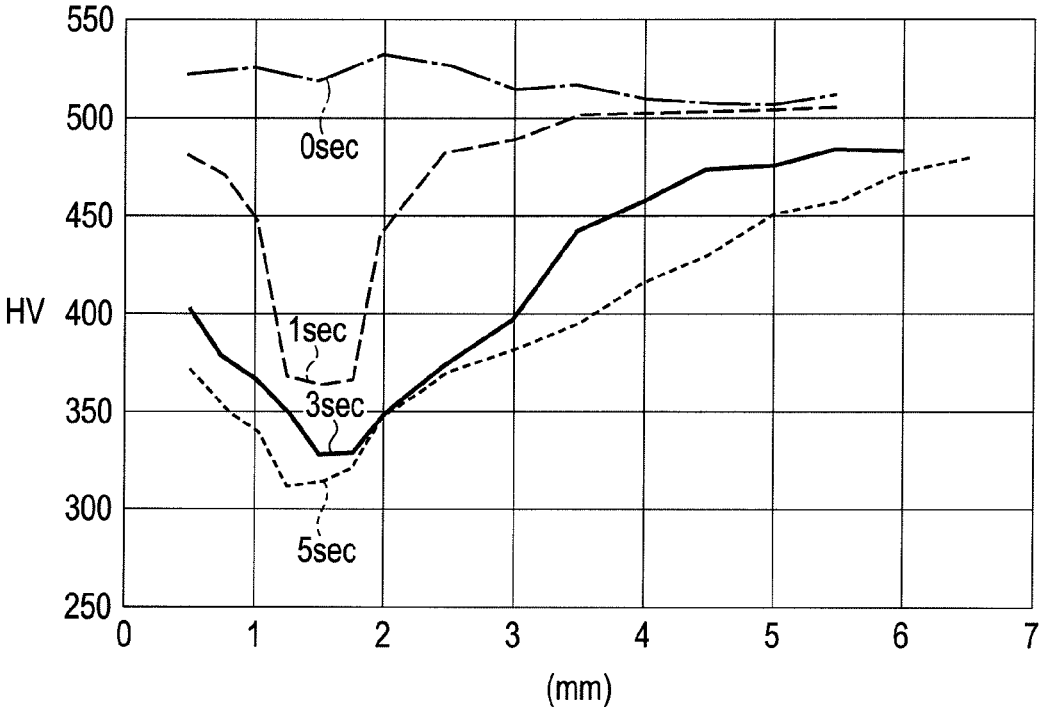
FIG. 8 is a graph depicting distributions of hardness after hardening, which explains a relation between keeping times after the primary press at 750 degrees C. and the hardness distributions.

FIG. 7 shows a relation between keeping times and Vickers hardness HV in a case where the starting temperature of the primary press was 600 degrees C. FIG. 8 shows results similarly taken in a case where the starting temperature of the primary press was 750 degrees C. In either example, reduction in HV could not be acknowledged when the keeping time was 0 seconds (immediately carrying out the final press). In either example, HV were prominently decreased at a region of from 1 mm through 3 mm apart from the edge of the hole when the keeping time was 1 second or more. When the keeping time was 5 seconds, HV decreased at any points even out of this region. Based on these results, the keeping time is preferably 1 second through 3 seconds.

As described above, the present embodiment enables local regulation of hardness of particular part of the product formed by hot-press forming.

Figure 10A:
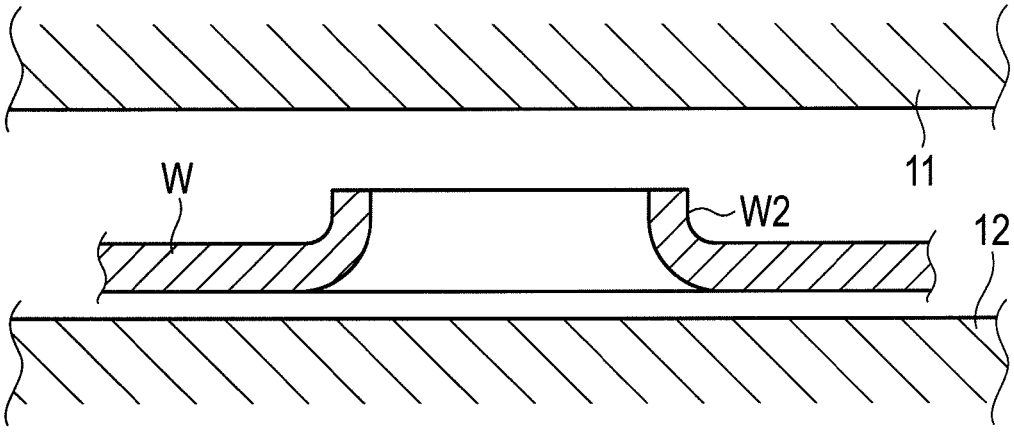
FIG. 10A is an elevational sectional view of a steel sheet and dies for pressing according to an example in that burring gives a preliminary deformation to the steel sheet.
Figure 10B:
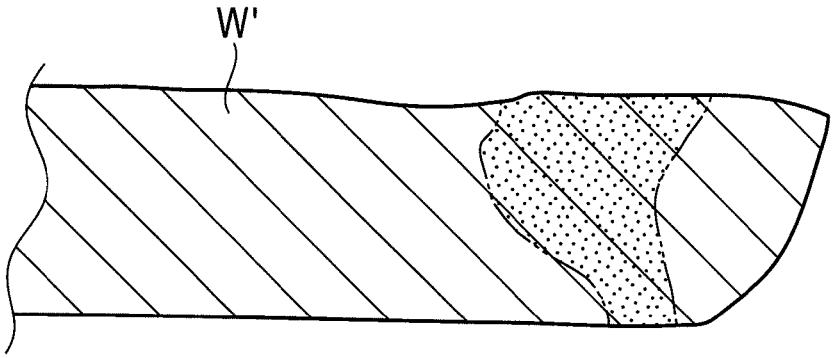
FIG. 10B is an enlarged sectional view around part given a local strain of the steel sheet shown in FIG. 10A after being treated with the primary press.
Figure 11A:
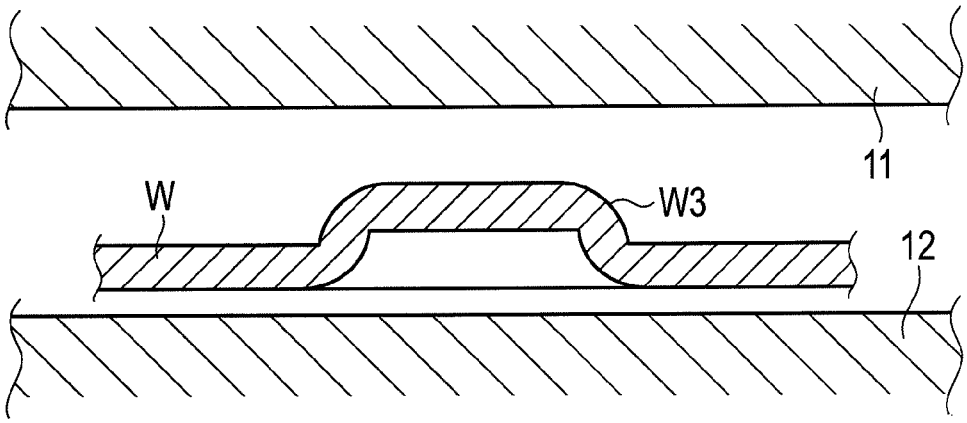
FIG. 11A is an elevational sectional view of a steel sheet and dies for pressing according to an example in that embossing gives a preliminary deformation to the steel sheet.
Figure 11B:
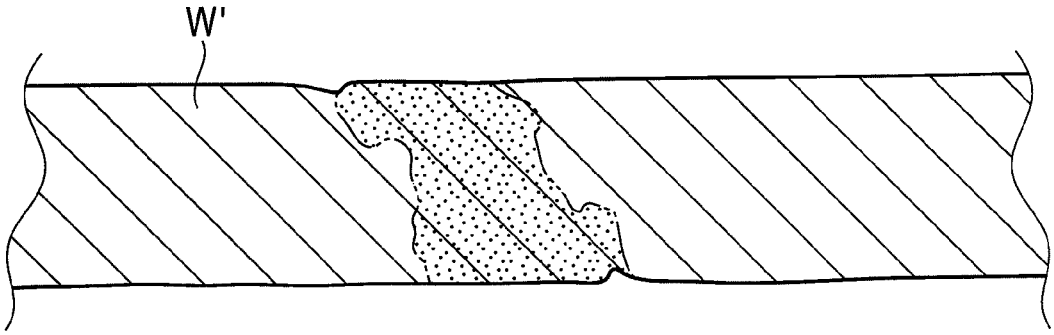
FIG. 11B is an enlarged sectional view around part given a local strain of the steel sheet shown in FIG. 11A after being treated with the primary press.
Figure 12A:
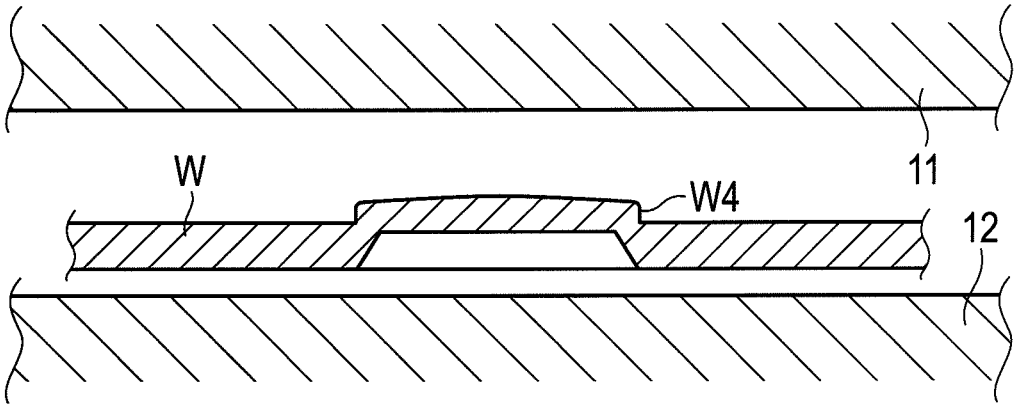
FIG. 12A is an elevational sectional view of a steel sheet and dies for pressing according to another example in that embossing gives a preliminary deformation to the steel sheet.
Figure 12B:
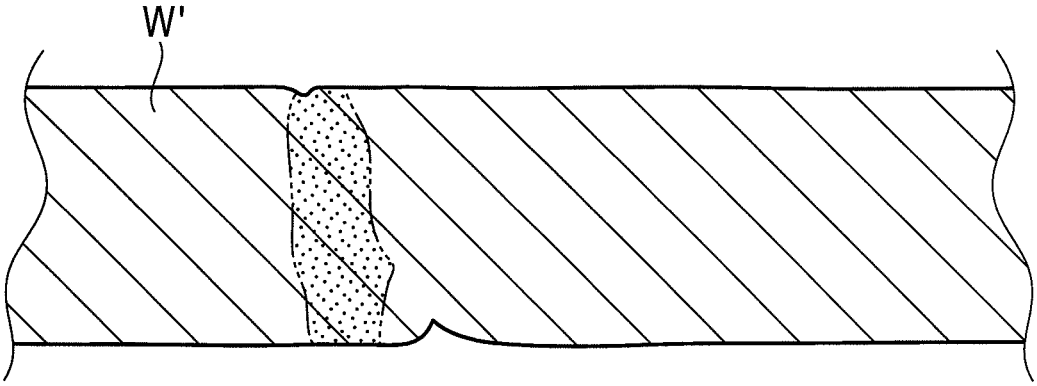
FIG. 12B is an enlarged sectional view around part given a local strain of the steel sheet shown in FIG. 12A after being treated with the primary press.
Figure 13A:
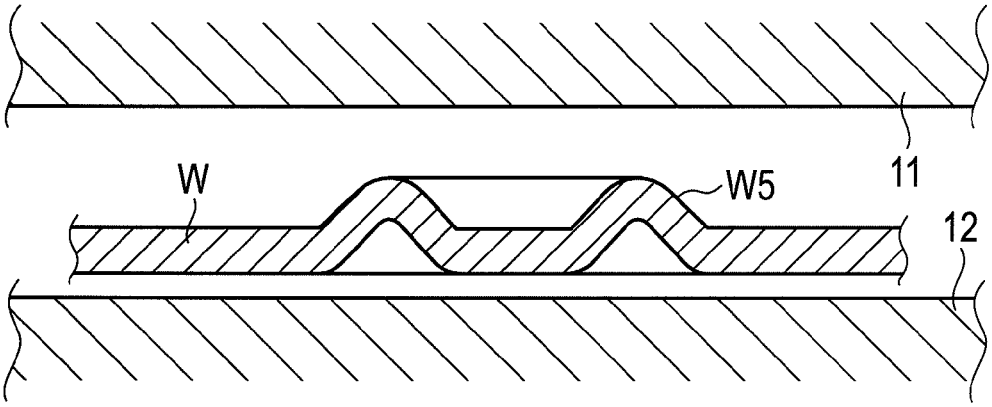
FIG. 13A is an elevational sectional view of a steel sheet and dies for pressing, in which the other example applies to a way of giving a preliminary deformation to the steel sheet.
Figure 13B:
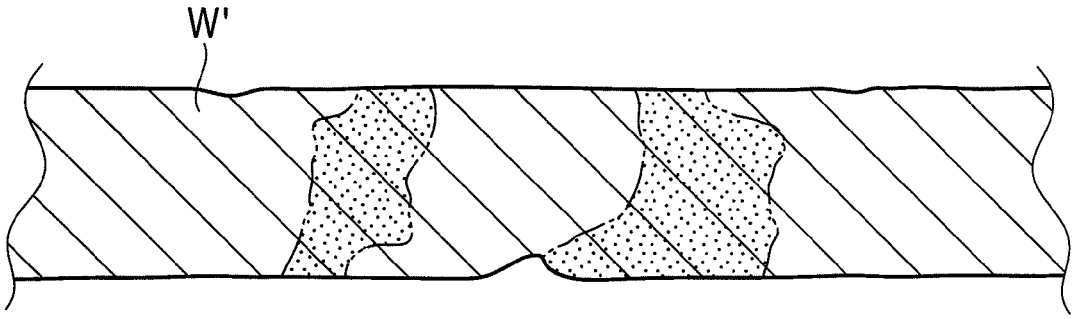
FIG. 13B is an enlarged sectional view around part given a local strain of the steel sheet shown in FIG. 13A after being treated with the primary press.

Various modification of the aforementioned embodiment will occur. For example, the step of giving a preliminary deformation may be carried out by means of burring as shown in FIG. 10A. Or, it may be carried out by means of embossing as shown in FIG. 11A, FIG. 12A or FIG. 13A. Squashing a convex W2, W3, W4 or W5 formed by burring or embossing in the primary press produces a sufficient strain as shown in FIG. 10B, 11B, 12B or 13B. The shape of the convex is not limited to those shown in these drawings. In each FIG. 10B, 11B, 12B or 13B, halftone dots are given to areas where the ferrite phase induced by the strain is generated and then hardness after hardening is lower than HV370.

Figure 14A:
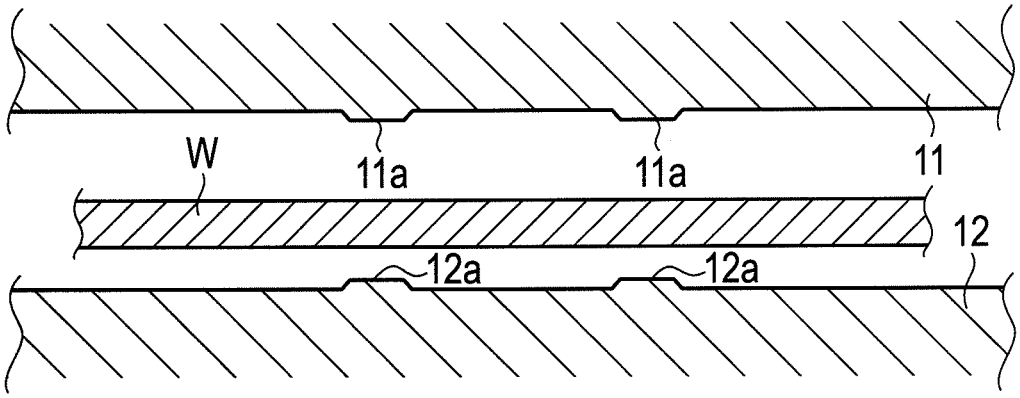
FIG. 14A is an elevational sectional view of a steel sheet and dies for pressing according to another example in that a local strain is given by means of indenting.
Figure 14B:
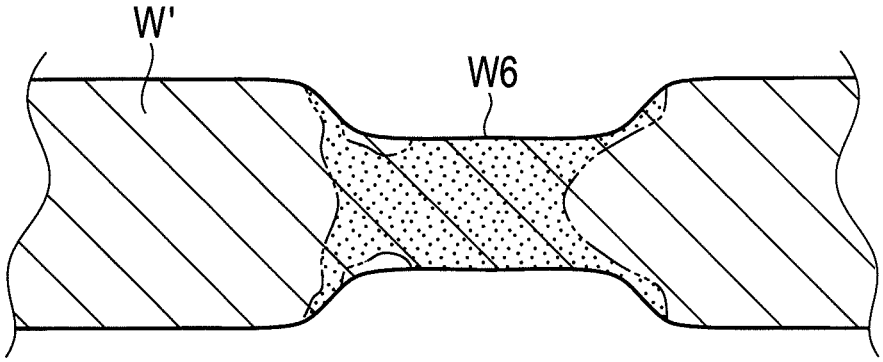
FIG. 14B is an enlarged sectional view around part given a local strain of the steel sheet shown in FIG. 14A after being treated with the primary press.
Figure 15A:
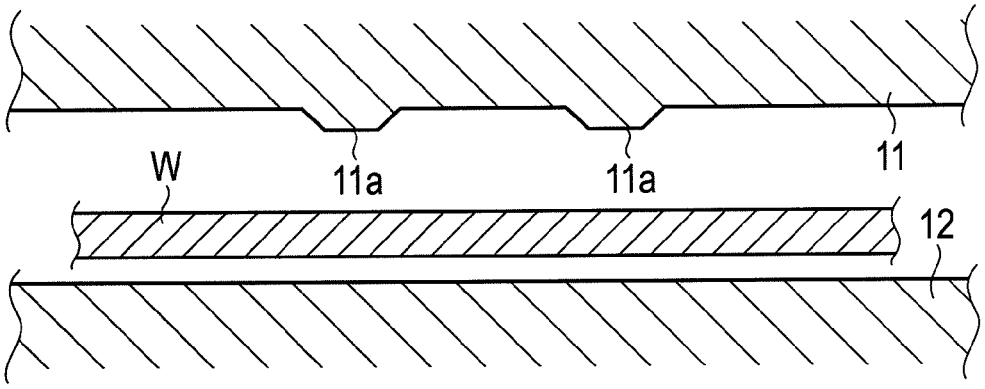
FIG. 15A is an elevational sectional view of a steel sheet and dies according to the other example.
Figure 15B:
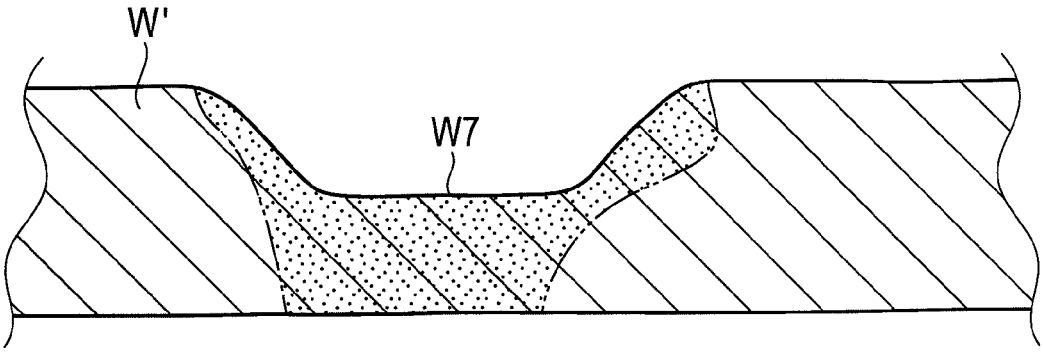
FIG. 15B is an enlarged sectional view around part given a local strain of the steel sheet shown in FIG. 15A after being treated with the primary press.
Figure 16A:
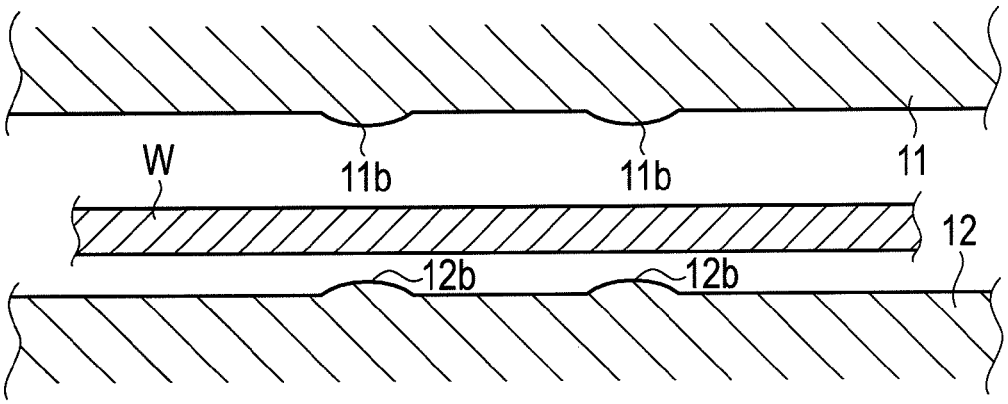
FIG. 16A is an elevational sectional view of a steel sheet and dies according to still the other example.
Figure 16B:
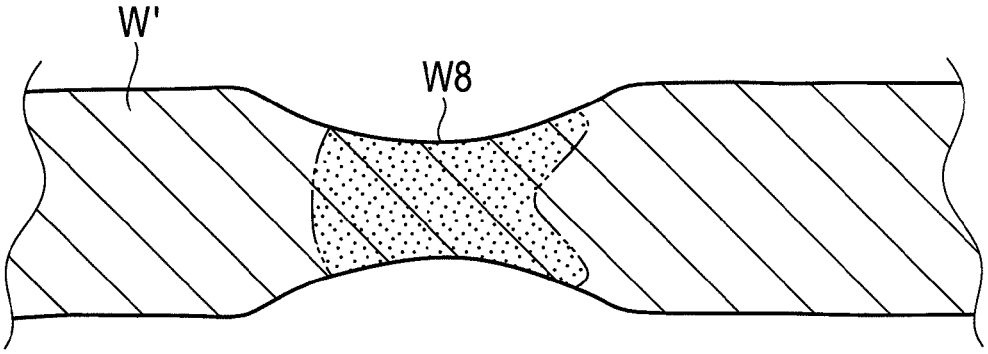
FIG. 16B is an enlarged sectional view around part given a local strain of the steel sheet shown in FIG. 16A after being treated with the primary press.
Figure 17A:
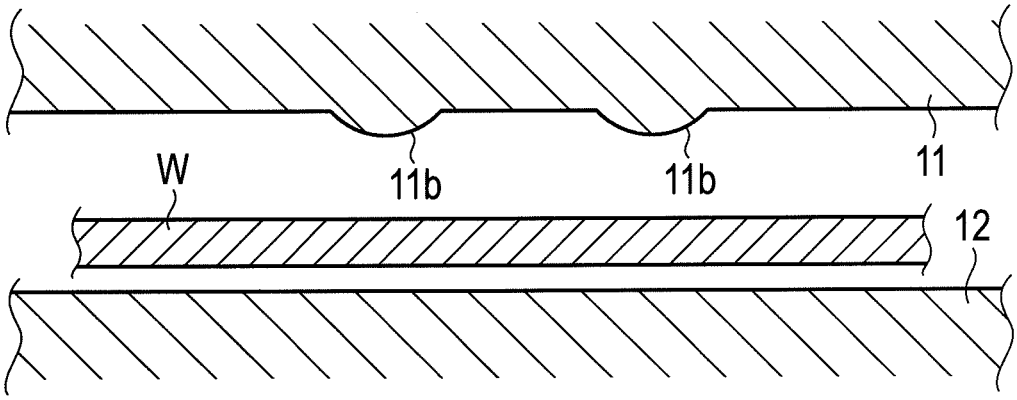
FIG. 17A is an elevational sectional view of a steel sheet and dies according to further still the other example.
Figure 17B:
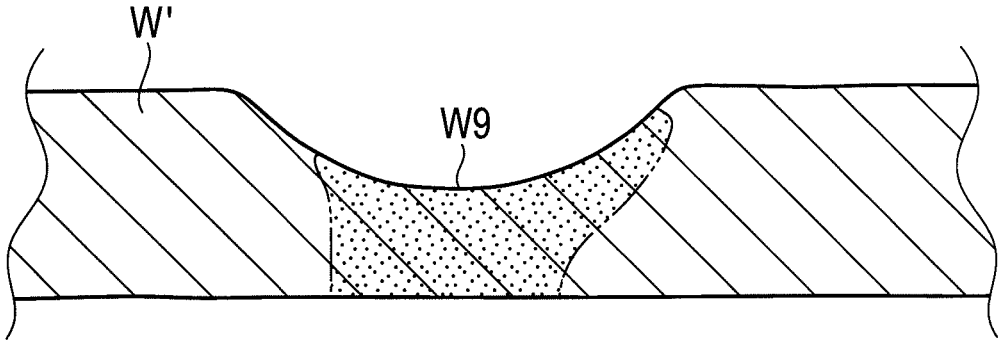
FIG. 17B is an enlarged sectional view around part given a local strain of the steel sheet shown in FIG. 17A after being treated with the primary press.

Further alternatively, a local strain may be given to a steel sheet at the primary pressing step without giving a preliminary deformation. For example, projections for indenting may be given to either or both of the upper die and the lower die and then hot-indenting may be carried out therewith. In the example of FIG. 14A, the upper die 11 is comprised of projections 11*a* in the shape of a trapezoid in cross section, and the lower die 12 is comprised of projections 12*a* in the shape of a trapezoid in cross section. In the example of FIG. 15A, only the upper die 11 is comprised of the projections 11*a*. In the example of FIG. 16A, the projections 11*b*, 12*b* are in the shape of an arc in cross section. In the example of FIG. 17A, only the upper die 11 is comprised of the projection 11*b*. As these are no more than examples, the shapes of the projections for example are not limited to those shown in the drawings.

The parts indented with the projections 11*a*, 12*a*, 11*b*, 12*b* are given local strains. As the steel sheet W' is, after hot-indenting, kept apart from the dies, the ferrite phases induced by the strains are generated at the parts W6, W7, W8, W9 as shown in FIGS. 14B, 15B, 16B, 17B. In FIGS. 14B, 15B, 16B, 17B, halftone dots are given to areas where the ferrite phases induced by the strain are generated and thereby hardness after hardening is lower than HV370. More specifically, hardness and strength at these parts do not prominently increase, even after the final press step. In other words, these parts are locally regulated in regard to hardness.

Figure 20:
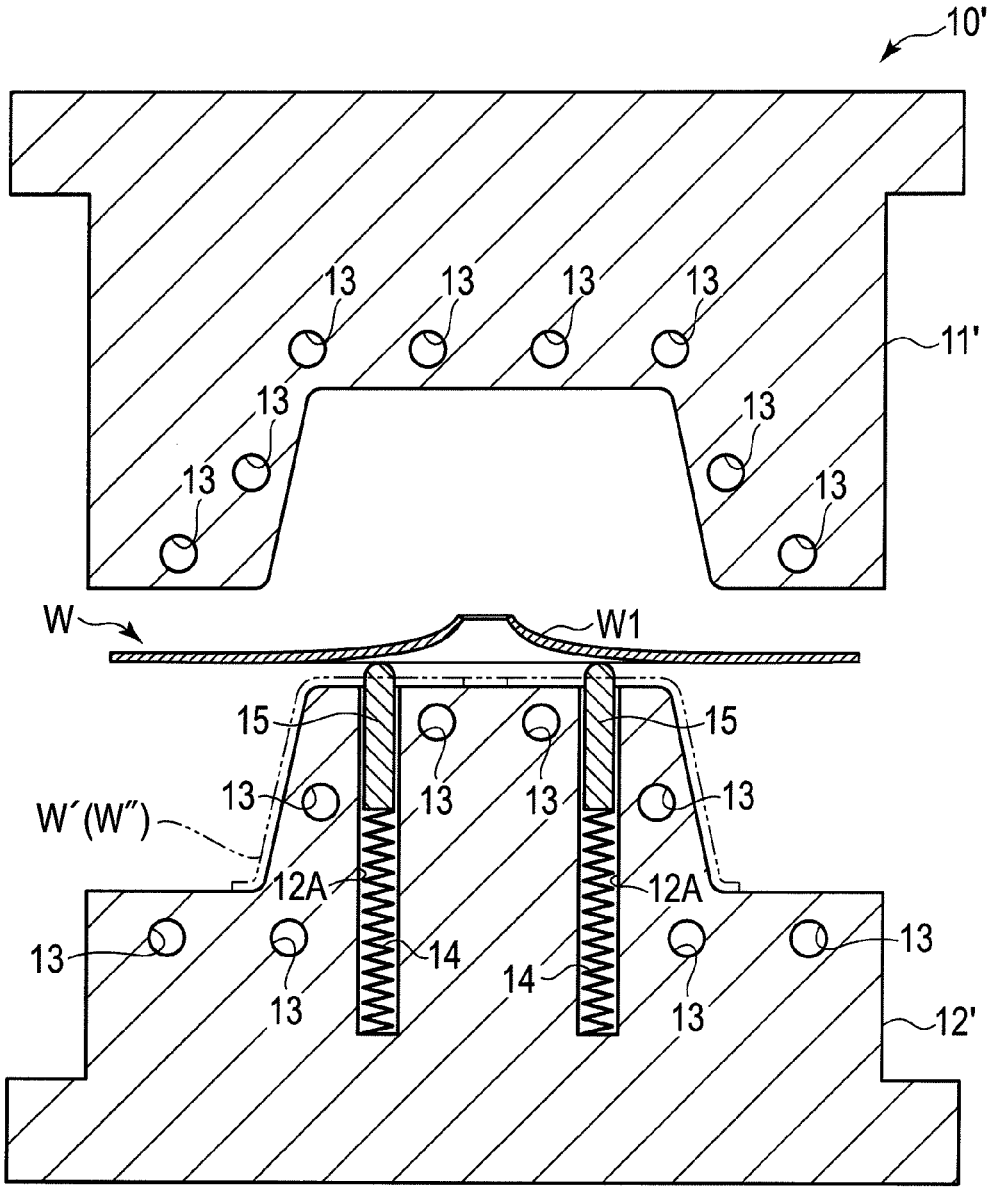
FIG. 20 is a schematic elevational sectional view of dies and a steel sheet according to a modified example.

Although the above descriptions illustrate examples in which flat products are produced because the flat dies 10 are used, various shapes can be of course produced by the hot-press forming. FIG. 20 shows an example of dies 10' used for forming a column W" having a flange (its cross section is similar to cross sections of silk hats).

A steel sheet W heated to a proper temperature in the heating furnace 30 is placed on the lower die 12'. In the primary press, the upper die 11' is pressed down and shortly thereafter made to ascend so that the convex W1 is squashed and a local strain is thereby given to the steel sheet W. After a proper period of time P, in the final press, the upper die 11' is again pressed down to make the steel sheet W' in close contact with the cold dies, thereby executing hardening. By taking the product out of the dies 10', the column W" having the flange is obtained.

As with the case described above, the parts given the local strain are relatively poor in martensite and are therefore locally regulated in regard to hardness. Although the steel sheet W is throughout deformed in the primary press, its degree is smaller. Therefore hardness increase is not totally regulated.

Figure 21:
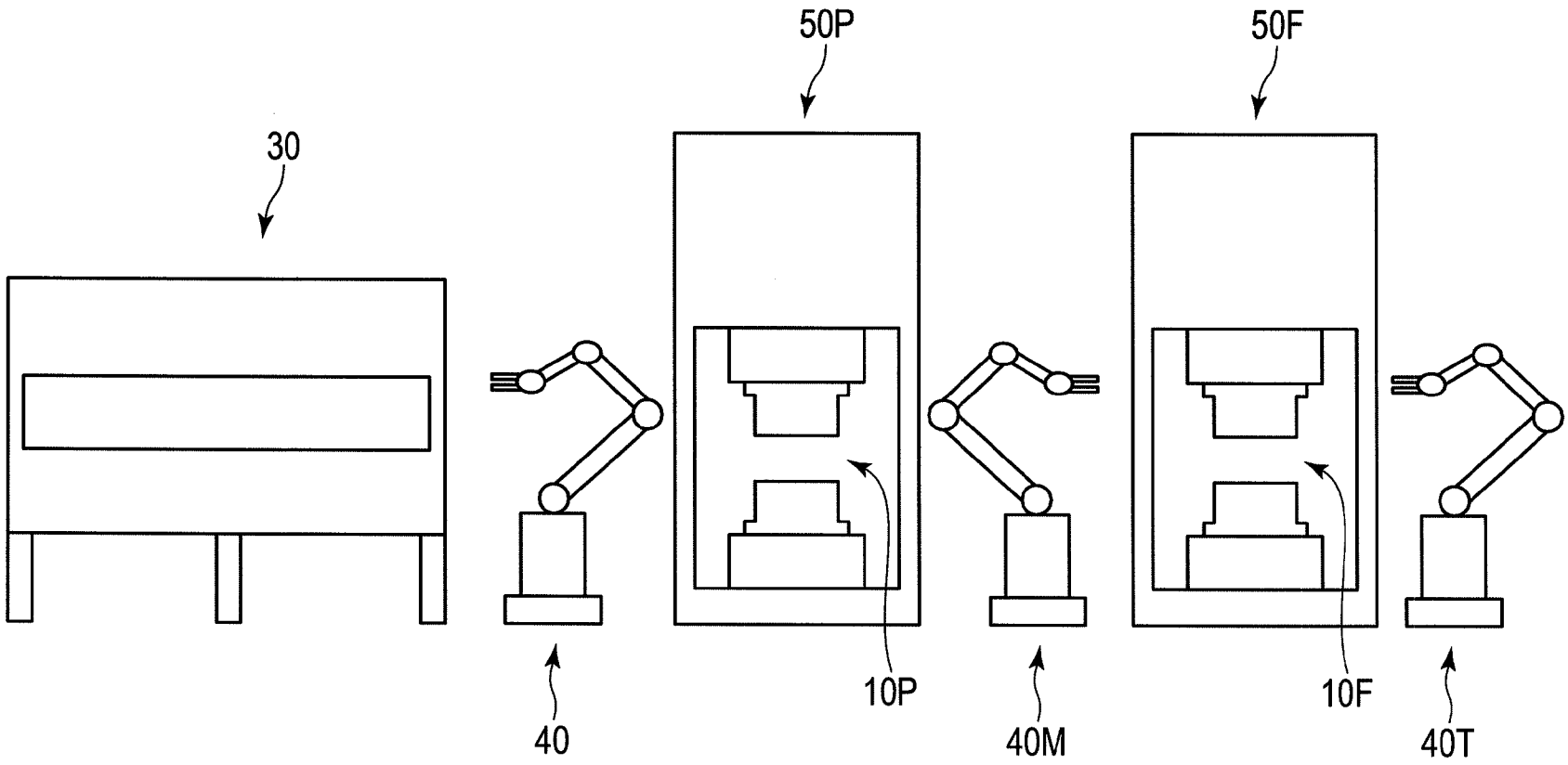
FIG. 21 is a schematic drawing showing an overview of a facility for hot-press forming according to the modified example.
Figure 22:
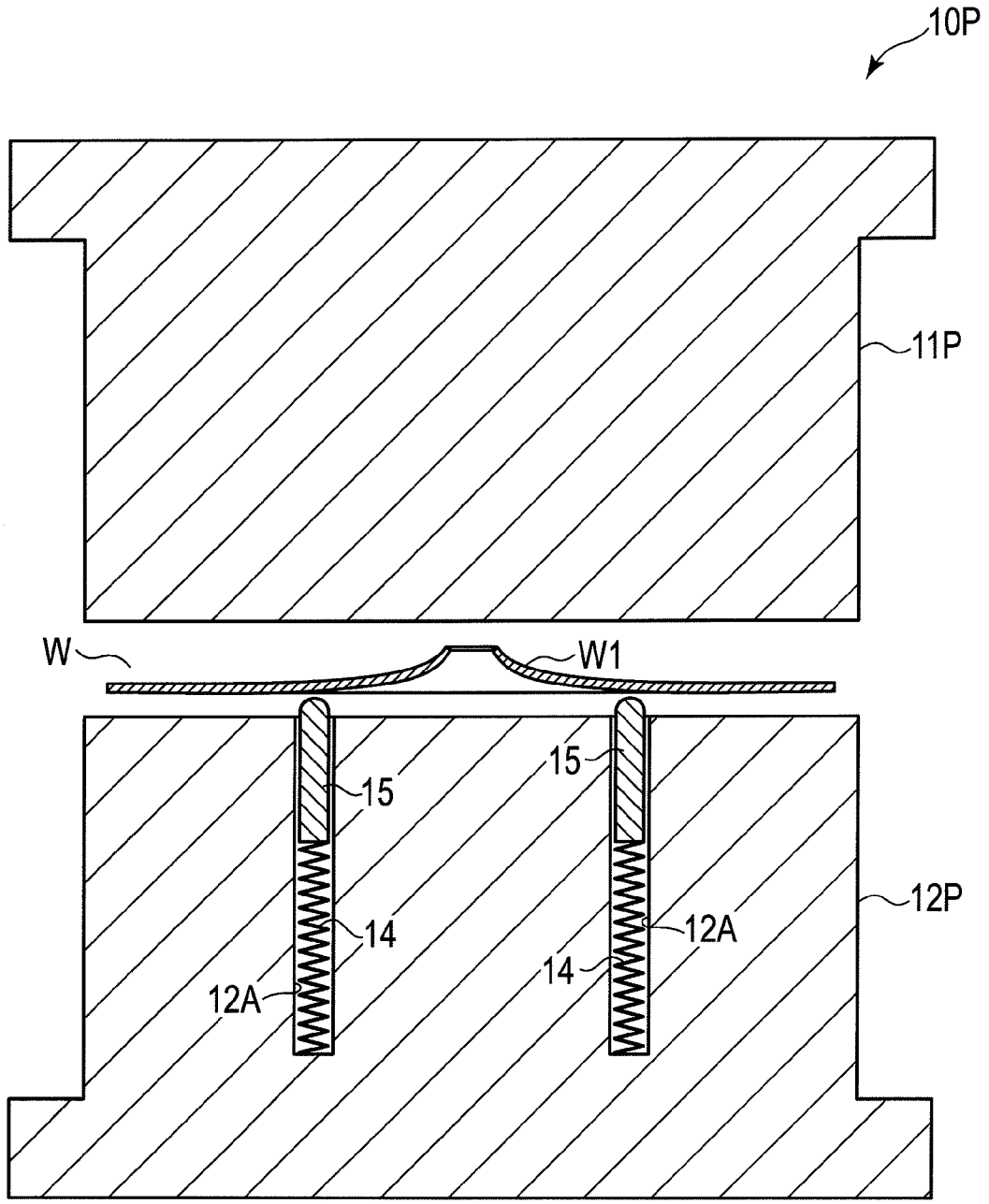
FIG. 22 is a schematic elevational sectional view of dies and a steel sheet served for a primary press in a method of hot-press forming according to a second modified example.
Figure 23:
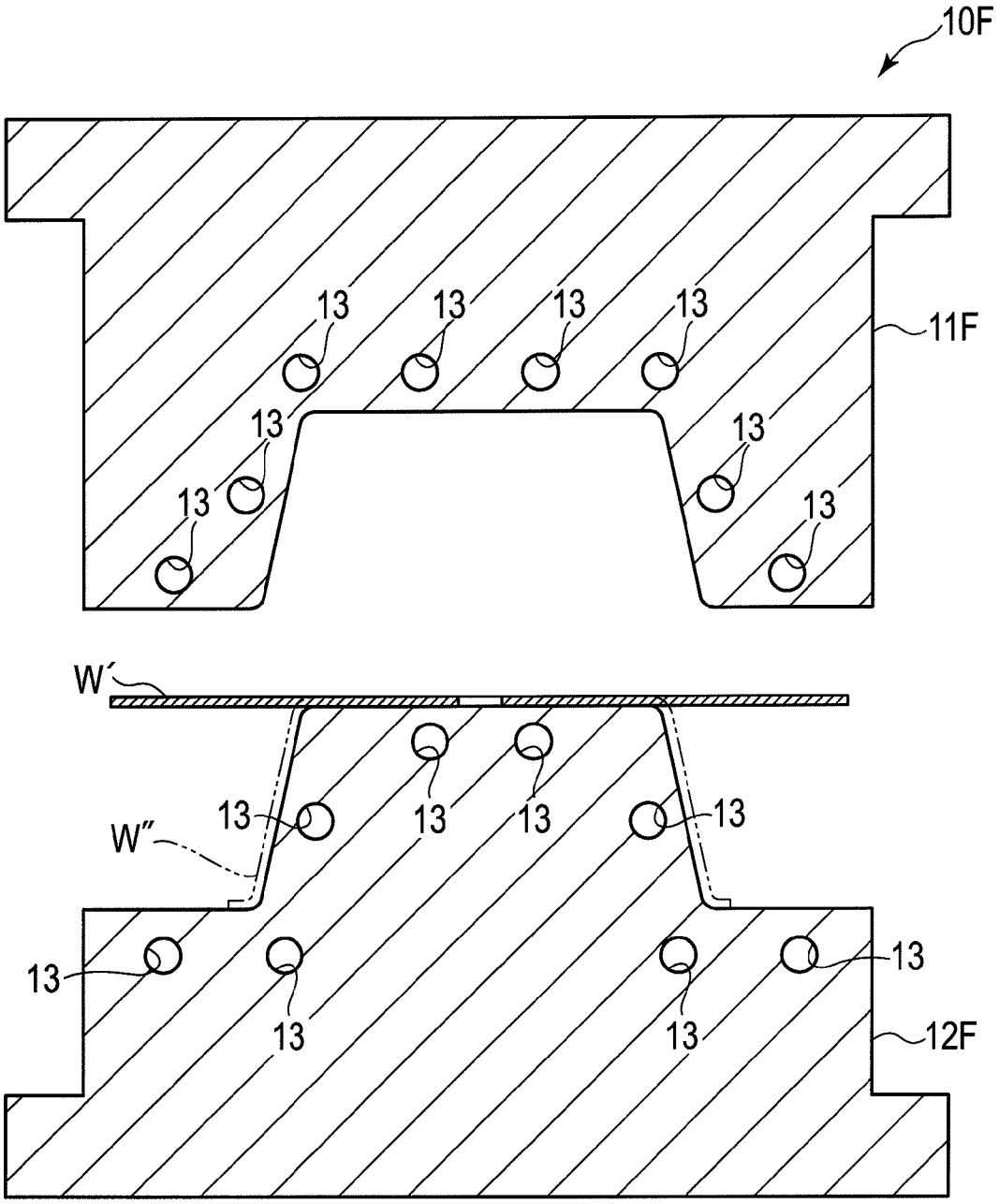
FIG. 23 is a schematic elevational sectional view of dies and a steel sheet served for a final press in the method of hot-press forming according to the second modified example.

Independent dies may be applied to the primary press and the final press, respectively. FIGS. 21 through 23 show an example of a device applied to such a modification. This device is comprised of a heating furnace 30, a first press machine 50P for a primary press, and a second press machine 50F for a final press. The device is preferably further comprised of a transporting device 40 for transporting a steel sheet from the furnace 30 to the first press machine 50P, a transporting device 40M for transporting a steel sheet from the first press machine 50P to the second press machine 50F, and a conveyance machine 40T for taking out products after press-forming. To the transporting devices 40, 40M and the conveyance machine 40T applicable are, not limited to, robot arms.

The first press machine 50P is comprised of dies 10P as shown in FIG. 22. The upper die 11P and the lower die 12P may have similar shapes to those of the aforementioned dies 10 but the conduits 13 for cooling may be omitted therefrom. The second press machine 50F is comprised of dies 10F as shown in FIG. 23. The upper die 11F and the lower die 12F may have similar shapes to those of the aforementioned dies 10' but the lift pins 15 may be omitted.

The steel sheet W heated to a proper temperature in the heating furnace 30 is introduced into the first press machine 50P and is there treated with the primary press. By pressing the upper die 11P down and immediately making it ascend, the convex W1 is squashed and a local strain is thereby given to the steel sheet W.

The steel sheet W' made flat is, during the keeping time P, transported to the second press machine 50F and placed on the lower die 12F. It is carried out to have the upper die 11F down, make the steel sheet W' in close contact with the cold die continuously, and thereby harden the steel sheet W'. By taking the product out of the dies 10F, the column W" having the flange is obtained.

As with the case described above, the part given the local strain is relatively poor in martensite and is therefore locally regulated in regard to hardness. The part given the local strain at the primary press step is limited to a particular part. While hardness is locally regulated at this part even after the final press step, the other parts are higher in hardness as being not given a strain.

Although the invention has been described above by reference to certain embodiments of the invention, the invention is not limited to the embodiments described above. Modifications and variations of the embodiments described above will occur to those skilled in the art, in light of the above teachings.

INDUSTRIAL APPLICABILITY

A method of hot-press forming that enables regulation of hardness of limited part is provided.

The invention claimed is:

1. A method of press-forming a hardenable steel sheet, the method comprising:

providing a die for pressing the steel sheet;

preliminarily deforming the steel sheet so as to change an initial shape of the steel sheet;

heating the steel sheet to a temperature of an $Ac_3$ point or higher, the $Ac_3$ point being a temperature at which transformation from ferrite into austenite completes;

carrying out a primary press on the heated steel sheet so as to flatten the preliminary deformation into the initial shape, thereby providing a local strain to a portion of the steel sheet;

keeping the steel sheet in a state apart from the die shortly after the primary press to cause a strain-induced ferrite transformation at the portion of the steel sheet, whereby the portion of the steel sheet is locally softened; and carrying out a subsequent press on the steel sheet kept in the state apart from the die and retaining the steel sheet in close contact with the die.

2. The method of claim 1, wherein the preliminary deformation is given by at least one selected from the group consisting of bending, indenting, burring and embossing.

3. The method of claim 1, wherein the subsequent press is carried out at a temperature from 600 to 800 degrees C.

4. The method of claim 1, wherein the close contact with the die is maintained for a period of time sufficient to cause a martensite transformation.

5. The method of claim 1, further comprising: shearing the portion of the steel sheet.

6. A method of press-forming a hardenable steel sheet, the method comprising:

providing a die for pressing the steel sheet;

preliminarily deforming the steel sheet so as to change an initial shape of the steel sheet;

heating the steel sheet to a temperature of an $Ac_3$ point or higher, the $Ac_3$ point being a temperature at which transformation from ferrite into austenite completes;

carrying out a primary press on the heated steel sheet so as to flatten the preliminary deformation into the initial shape, thereby providing local strain to a portion of the steel sheet;

keeping the steel sheet in a state apart from the die shortly after the primary press to cause a strain-induced ferrite transformation at the portion of the steel sheet, whereby the portion of the steel sheet is locally softened; and carrying out a subsequent press on the steel sheet kept in the state apart from the die and retaining the steel sheet in close contact with the die, wherein the primary press is carried out at a temperature from 600 to 800 degrees C.

7. The method of claim 6, wherein the preliminary deformation is given by at least one selected from the group consisting of bending, indenting, burring and embossing.

8. The method of claim 6, wherein the state apart from the die is kept for 1 second or more.

9. The method of claim 6, wherein the subsequent press is carried out at a temperature from 600 to 800 degrees C.

10. The method of claim 6, wherein the close contact with the die is maintained for a period of time sufficient to cause a martensite transformation.

11. The method of claim 6, further comprising: shearing the portion of the steel sheet.

12. A method of press-forming a hardenable steel sheet, the method comprising:

providing a die for pressing the steel sheet;

preliminarily deforming the steel sheet so as to change an initial shape of the steel sheet;

heating the steel sheet to a temperature of an $Ac_3$ point or higher, the $Ac_3$ point being a temperature at which transformation from ferrite into austenite completes;

carrying out a primary press on the heated steel sheet so as to flatten the preliminary deformation into the initial shape, thereby providing local strain to a portion of the steel sheet;

keeping the steel sheet in a state apart from the die shortly after the primary press to cause a strain-induced ferrite transformation at the portion of the steel sheet, whereby the portion of the steel sheet is locally softened; and carrying out a subsequent press on the steel sheet kept in the state and retaining the steel sheet in close contact with the die, wherein the state apart from the die is kept for 1 second or more.

13. The method of claim 12, wherein the preliminary deformation is given by at least one selected from the group consisting of bending, indenting, burring and embossing.

14. The method of claim 12, wherein the primary press is carried out at a temperature from 600 to 800 degrees C.

15. The method of claim 12, wherein the subsequent press is carried out at a temperature from 600 to 800 degrees C.

16. The method of claim 12, wherein the close contact with the die is maintained for a period of time sufficient to cause a martensite transformation.

17. The method of claim 12, further comprising: shearing the portion of the steel sheet.

* * * * *